United States Patent [19]

Allen

[11] Patent Number: 4,581,013

[45] Date of Patent: Apr. 8, 1986

[54] DOSER FOR ORALLY ADMINISTERING MEDICINE

[75] Inventor: Randy B. Allen, Rock Hill, S.C.

[73] Assignees: Jane C. A. Hayes; Angela B. Allen; Ashley J. Allen, all of Rock Hill, S.C.

[21] Appl. No.: 520,509

[22] Filed: Aug. 4, 1983

Related U.S. Application Data

[63] Continuation-in-part of Ser. No. 369,585, Apr. 19, 1982, abandoned.

[51] Int. Cl.[4] ..... A61J 7/00

[52] U.S. Cl. ..... 604/78; 604/57; 604/59; 604/77; 604/189; 604/84; 604/85; 604/247; 604/256

[58] Field of Search ..... 604/19, 48, 49, 54, 604/56, 57–64, 77, 78, 82–85, 89, 92, 93, 111, 189, 256

[56] References Cited

U.S. PATENT DOCUMENTS

| | | | |
|---|---|---|---|
| 121,684 | 12/1871 | Sullivan | 604/57 |
| 430,928 | 6/1890 | Doty | 604/59 |
| 697,209 | 4/1902 | Koppenhagen | 604/59 |
| 1,685,280 | 9/1928 | Findley | 604/58 |
| 2,436,505 | 2/1948 | Du Rall | 604/77 |
| 3,072,120 | 1/1963 | Sharp et al. | 604/189 |
| 3,424,158 | 1/1969 | Silver | 604/54 |
| 3,905,477 | 9/1975 | Graham | 604/189 |
| 3,980,074 | 9/1976 | Watt et al. | 604/58 |
| 4,390,104 | 6/1983 | Cummings | 604/111 |
| 4,440,207 | 4/1984 | Genatempo | 604/256 |

*Primary Examiner*—C. Fred Rosenbaum
*Assistant Examiner*—Michelle N. Lester
*Attorney, Agent, or Firm*—Luke J. Wilburn, Jr.

[57] ABSTRACT

A device for orally administering medication by inclusion of a diluent liquid with the medication ingested into the oral cavity. The dosing device in one embodiment has a mouthpiece, a first conduit means for providing a stream of liquid diluent and a second conduit means for positively injecting a liquid medication into the stream of diluent liquid. The dosing device additionally includes as a preferred feature means for supporting a solid medication within the mouthpiece for inclusion within a stream of diluent liquid. In another embodiment, the dosing device comprises a container for solid medicine which is a tubular mouthpiece having a closure cap and a radially flanged base plate for support of the mouthpiece in upright position on a support surface, and a support grid in the tube for the solid medicine. The lower end of the tubular mouthpiece is adapted to receive a drinking straw, and the lower end of the straw is inserted into a diluent liquid source whereby inhalation on the mouthpiece draws the solid medicine and diluent liquid into the oral cavity of the user.

8 Claims, 13 Drawing Figures

DOSER FOR ORALLY ADMINISTERING MEDICINE

BACKGROUND OF THE INVENTION

This application is a continuation-in-part of my copending U.S. patent application Ser. No. 06/369,585, filed Apr. 19, 1982 and now abandoned.

This invention relates generally to a device for facilitating the intake of medicine, and more particularly, to a device for facilitating the oral intake of liquid and/or solid medicine.

Several devices exist within the prior art for facilitating the oral intake of solid medication in the form of pills or tablets. One such device is described in U.S. Pat. No. 2,436,505 to DuRall. The device described therein is a generally tubular or straw like device having an expanded mouthpiece for retaining a solid medication thereon. The device is utilized by inhaling a liquid through the tubular member similar to the normal use of a straw to inhale the liquid while simultaneously drawing the solid medication into the oral cavity and subsequently ingesting the medication by swallowing it along with the liquid.

Another such device is described in U.S. Pat. No. 697,209 to Koppenhagen. Disclosed therein is a device for containing a liquid and suspending a solid medication. The liquid and solid medication are ingested by turning the device upright to allow the liquid and medication to move into the mouth by the force of gravity.

Another such device is described in U.S. Pat. No. 121,684 to Sullivan. The device described therein is generally in the form of a kettle having means for insertion of a solid medication into a spout thereof. The spout is taken into the mouth for ingesting the liquid therein while a solid medication is inserted into the spout for flow into the oral cavity along with the stream of liquid.

German Pat. No. 354,716 of April 1921 appears from its drawing to disclose a container for liquid medicine connected by a valve to a tube which may be used to ingest by suction the medicine and a diluent liquid in which the tube is dipped.

A device for facilitating the oral intake of liquid medicine has been marketed which comprises a cup with an upper compartment for the deposit of medication. The device administers the medicine when the cup is turned up for drinking by having the medicine from the upper compartment pass along with the liquid from the cup bottom into the oral cavity.

Many venous catheter devices provide for the introduction of a liquid medication into a stream of other fluid being introduced into the bloodstream. One such device is described in U.S. Pat. No. 4,072,146 to Howes.

U.S. Pat. Nos. 2,686,441; 2,756,740; 3,426,755; 3,738,363; 3,777,742; 4,196,747; 4,249,535; and 4,299,705 disclose other devices for medication feeding.

While many devices, as discussed above, exist for facilitating the oral ingestion of medication, problems associated with the oral ingestion of liquid and solid medication remain.

SUMMARY OF THE INVENTION

It is thus an object of this invention to provide a dosing device for facilitating the oral administration of solid medicines.

It is a further object of this invention to provide a dosing device which facilitates the oral administration of both solid and liquid medicines.

It is another object to provide a dosing device to facilitate oral administration of solid medicines wherein the device also serves as a container/dispenser for solid medicine dosages given to patients for ingestion, as the dispensing of prescribed doses of medicine by a nurse to a hospital patient.

These as well as other objects are accomplished by provision of a dosing device which in one embodiment comprises a mouthpice, a first conduit means communicating with the mouthpiece for conducting a stream of diluent liquid into the mouthpiece, and a second conduit means for injecting a liquid medicine into the stream of liquid diluent. The dosing device also includes means positioned in the mouthpiece for supporting a solid medicine for inhalation ingestion with diluent liquid.

In another embodiment, the dosing device comprises a mouthpiece device forming a compartment for temporarily storing and protecting dispensed dosages of medicine, and wherein the mouthpiece includes mean for connection to a conduit, such as a straw, whereby human inhalation suction on the mouthpiece causes ingestion of the solid medicine dosage from the conpartment along with a diluent liquid which is drawn into and through the compartment from a diluent liquid source in which the straw is disposed.

DETAILED DESCRIPTION

Figure 2:
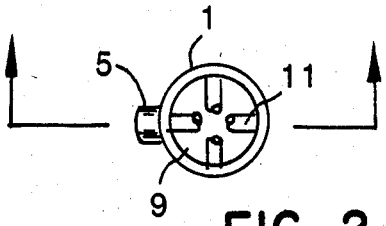
FIG. 2 of the drawings illustrates a top view of the device in accordance with FIG. 1.

In accordance with this invention, it has been found that medicines may be orally administered by the drawing of a liquid diluent into the oral cavity by inhalation action along with the medicine. The inhalation action utilized in practicing this invention is the conventional drawing or sucking of a liquid into the oral cavity for the consumption thereof, as through a straw. Thus by the practice of this invention, a solid redicine, such as one or more pills or tablets, is drawn into the oral cavity and swallowed by including the solid medicine within the stream of liquid drawn into the oral cavity. In a preferred form of the invention, a mouthpiece device is provided whereby a solid medication in a prescribed dosage may be delivered in stored and protected condition, and a straw may be attached to the mouthpiece and the solid medication inhaled with a diluent liquid to facilitate ingestion of the same. The description of the dosing devices utilized in practicing this invention will be given with reference to the included Figures of the drawings.

Figure 1:
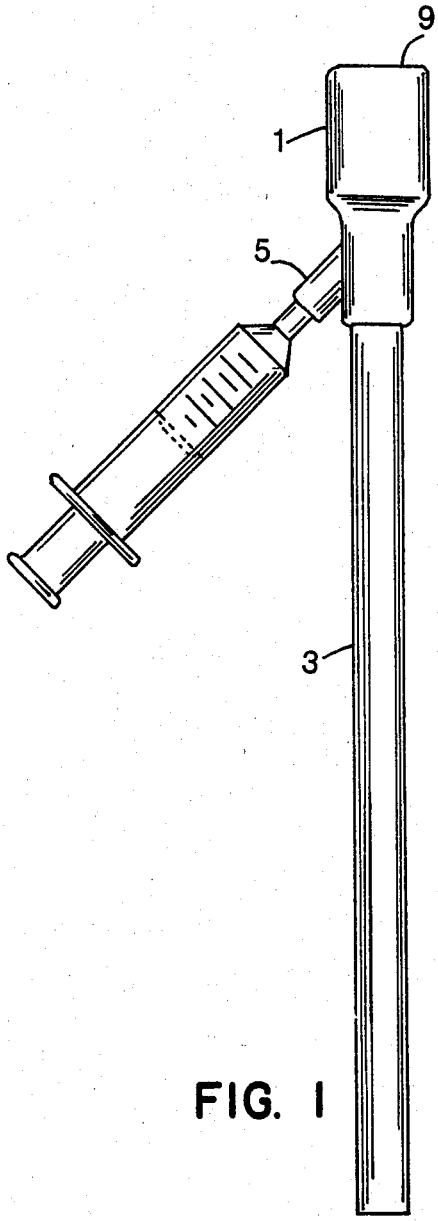
FIG. 1 of the drawings schematically illustrates a first embodiment of a dosing device in accordance with this invention.

FIGS. 1–9 of the drawings illustrate one embodiment of a dosing device in accordance with this invention. The device comprises a mouthpiece 1 communicating with a first conduit means 3 and a second conduit means 5. The first conduit means 3 is preferably an ordinary soda fountain straw. Thus the device shown in FIG. 1 is utilized for the oral ingestion of a solid or liquid medication by drawing a diluent liquid through first conduit means 3 in normal fashion. At some point after the diluent liquid has reached the oral cavity of the user, a liquid medication may be injected into the second conduit means portion 5 for inclusion with the stream of diluent liquid being drawn through first conduit means 3. Second conduit means preferably includes a syringe 7 for positively injecting the liquid medication. The liquid diluent utilized in the practice of this invention is a liquid to which the user has no objection to swallowing. Such diluent liquids may include fruit juices, water or cola beverages. By utilizing the dosing device and process of this invention, the patient or user is able to orally ingest a liquid medication with a minimum amount of displeasure because of the inclusion of the medication within a stream of non-objectionable diluent liquid.

As is illustrated in FIG. 1 of the drawings, the location of the second conduit means 5 with respect to the upper opening 9 of mouthpiece 1 is such as to facilitate the injection of a liquid medication into a stream of diluent liquid. The second conduit means portion 5 is angled with respect to the first conduit means 3 so as to form an acute angle to maximize the efficiency of the step of injecting the medication liquid into the diluent liquid. Preferably the acute angle is as small as possible while still permitting the insertion of an injection means such as syringe 7. Generally the angle may be within the range of 15 to 45 degrees. Preferably the location of the point of communication between the second conduit means 5 with respect to the opening 9 in mouthpiece 1 is short so as to minimize the possibility of medication re-entering a reservoir of diluent liquid. It is preferred that the second conduit means communicate with a stream of liquid at a point no further than two inches from the opening 9 and more preferably, one inch. The close proximity of the point of communication of the second conduit means 5 with the stream of diluent liquid serves a dual purpose. The first purpose is to minimize the likelihood that the medication would enter a reservoir of diluent liquid. Secondly, it is frequently desirable to be able to quickly introduce the liquid medicine without the patient having the ability to perceive its introduction prior to the point of swallowing the liquid medication. When practicing the invention on small children, it is frequently desirable to introduce the liquid medication without the patient visibly detecting its introduction. If injection is detected, it is desirable that the patient not have time to perceive a taste difference prior to swallowing the liquid medication.

As shown in FIG. 1 of the drawings, the first conduit means 3 is generally tubular and hollow as is mouthpiece 1 and second conduit means 5. FIG. 2 of the drawings illustrates a top view of the mouthpiece shown in FIG. 1 having included therein a preferred feature of this invention. Shown in FIG. 2 of the drawings are means 11 for supporting a solid medication within the mouthpiece 1. Further understanding of the location of the means for supporting a solid medication may be had by referring to FIG. 3 of the drawings which is a cutaway view along line III—III of FIG. 2 of the drawings. The means for supporting a solid medication, as depicted, comprises a series of supports 13 which permit the passage of a stream from the first conduit means 3 through the mouthpiece 1 out of the opening 9. While this is shown as a series of individual supports, it is understood that any construction which permits the passage of fluid while also supporting a solid medication such as a tablet or capsule therein is suitable for use in accordance with this preferred embodiment. Thus, the support means may be formed of a grid suspended across the interior of mouthpiece 1 or a perforated membrane as well as any other suitable support means which serves the above discussed function.

Figure 4:
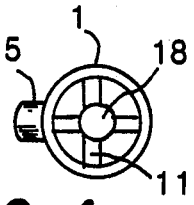
FIG. 4 of the drawings is a view similar to FIG. 2 of the drawings having disposed therein a solid medicine for ingestion in accordance with this invention.

While utilizing the dosing device of FIG. 1 for the oral ingestion of solid medication, communication with second conduit means 5 is interrupted by manipulation of the device in a manner to be described below. While the communication is interrupted, a solid medication is placed upon the upper surface of support means 11. FIG. 4 of the drawings is a figure similar to FIG. 2 showing a tablet 18 placed upon the upper surface of support means 11. In order to orally ingest the solid medication, the lower end of first conduit means 3 is placed within a reservoir of liquid diluent similar that described above. The patient or user of the device then draws a liquid diluent through the first conduit means 3 and out of the opening 9 in mouthpiece 1. The drawing by inhalation action causes not only the flow of a stream of liquid diluent, but also the inclusion therein of solid medication 18 for easy and almost imperceptible swallowing by the patient or user thereof.

Figure 3:
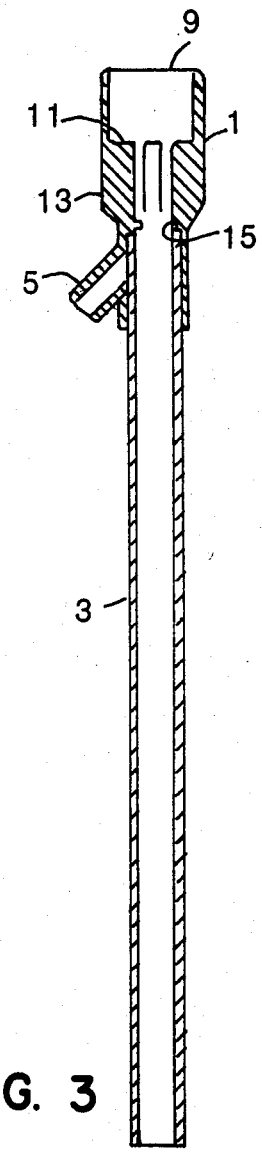
FIG. 3 of the drawings illustrates a cross section along the line III—III of FIG. 2.

The interruption of communication with second conduit means 5 as discussed above is carried out by any convenient means. For example, the second conduit means 5, may be plugged as by placing a plug or an obstruction such as a finger over the opening of second conduit means 5 so as to cause interruption of any flow that may occur through second conduit means 5. FIG. 3 of the drawings illustrates in cross section thereof the location of the first conduit means 3, such as a straw, in a position so as to interrupt communication with second conduit means 5. In the embodiment shown in FIG. 3, the first conduit means 3 is positioned within the mouthpiece 1 against an inwardly projecting ridge 15. When the mouthpiece is in this first position, the communication with second conduit means 5 is interrupted.

Figure 5:
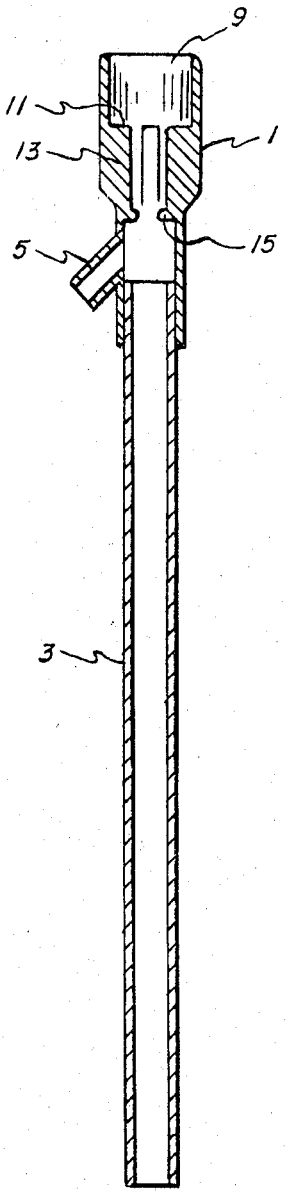
FIG. 5 of the drawings is a cross section view similar to FIG. 3 with a variation in the position of one of the members therein.

FIG. 5 of the drawings illustrates the first conduit means 3 at a second position within mouthpiece 1 so that flow communication with second conduit means 5 is established with the opening 9 of mouthpiece 1. The embodiment shown in FIG. 3 and FIG. 5 requires that first conduit means 3 be slidably received within the lower opening of mouthpiece 1.

Figure 6:
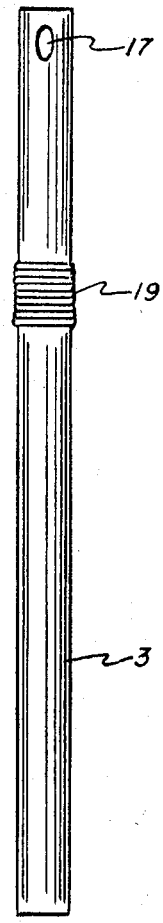
FIG. 6 of the drawings illustrates a modification which may be applied to the embodiment of FIGS. 1–5.

FIG. 6 of the drawings illustrates a modification wherein the first conduit means 3 defines at its upper extremity an orifice 17 for establishing communication with second conduit means 5 when the first conduit means is positioned against ridge 15 of mouthpiece 1. In this modification, the first conduit means 3 is rotatably received within the lower end of mouthpiece 1. When orifice 17 is positioned adjacent the second conduit means 5, flow communication is established between second conduit means 5 and mouthpiece 1 through a portion of first conduit means 3. However, upon rotation of first conduit means 3 within mouthpiece 1 communication is interrupted due to the non-alignment of orifice 17 with second conduit means 5. Appropriate indicia (not shown) may be included on the mouthpiece 1 and first conduit means 3 in order to indicate alignment. An additional optional feature is illustrated in FIG. 6 wherein a bellows portion 19 is included in order to render the first conduit means 3 flexible so as to ease the task of appropriately aligning the mouthpiece and reservoir for use by a patient.

Figure 7:
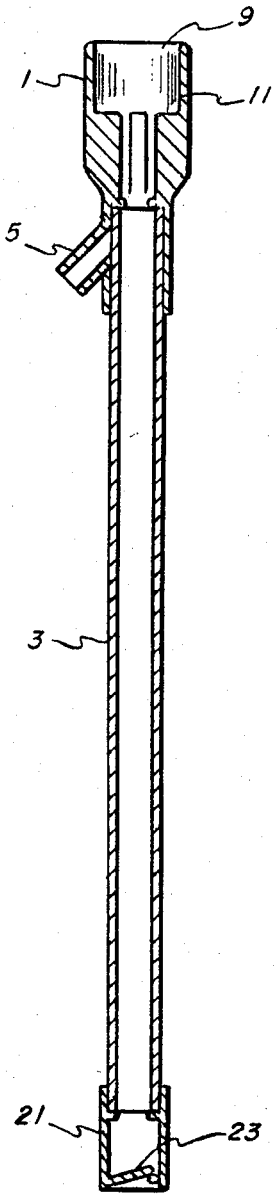
FIG. 7 of the drawings illustrates a further modification of the embodiment of FIGS. 1–6 with the inclusion of a one way valve thereon.

FIG. 7 of the drawings shows a further optional feature which may be included with the doser of FIGS. 1–6. Shown therein is an attachment 21 to first conduit means 3 with a one way valve 23 to prevent any of the liquid medication communicated through second conduit means 5 from reaching a reservoir of liquid diluent. This assures that any pause in the act of drawing liquid into the oral cavity will not be accompanied by a loss of medication into the reservoir of liquid diluent. With the one way valve any liquid medication having been ejected from syringe 7 will be retained within the confined volume of the doser.

As a preferred feature of the doser illustrated in FIGS. 1–7 of the drawings, the first conduit means 3 is preferably a soda fountain straw of the type adapted to be utilized with liquid substances, such as milkshakes. Generally, the straws are of a standard inner diameter of about 5/16 inch. This assures that the consumer may readily replace this portion of the dosing device of this invention without significant expense.

In actuality the doser may comprise merely the mouthpiece 1 with the second conduit means 5 attached thereto, with the consumer providing the first conduit means 3 for use during an actual dosing procedure. In this event, a conventional soda fountain straw is positioned within the mouthpiece so as provide communication between itself and the mouthpiece. In a like manner, attachment 21 may be positioned at the end of the soda fountain straw opposite the mouthpiece. A measured quantity of liquid medicine may thus be administered from syringe 7 while a stream of liquid diluent passes through first conduit means 3.

In this embodiment, the mouthpiece 1 as well as the second conduit means 5 is preferably of unitary construction. Such a construction may be formed by any conventional means, such as injection or compression molding of a thermoplastic material, such as polyethylene. It is additionally contemplated that the doser including the first conduit means may be of unitary construction.

Figure 8:
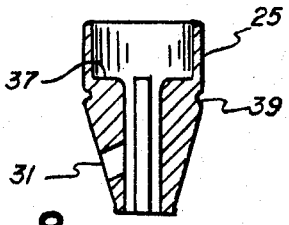
FIGS. 8 and 9 illustrate in cross section an alternative modification of the embodiment of FIG. 1.
Figure 9:
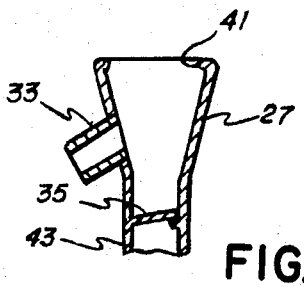

An alternative modification is illustrated in FIG. 8 and FIG. 9. In this modification, a mouthpiece 25 is adaptable for being received within an outer sleeve 27, illustrated in FIG. 9. In this embodiment, when mouthpiece 25 is inserted into the sleeve 27, orifice 31 defined by mouthpiece 25 may be properly aligned with second conduit means 33 on sleeve 27 to provide for flow of communication into the mouthpiece 25. Rotation of the sleeve 27 interrupts the flow of communication through the orifice 31. Sleeve 27 additionally includes within its lower extremity a one way valve 35 for prevention of communication between liquid medication entering through the orifice 31 and a source of liquid diluent.

The modification illustrated in FIGS. 8 and 9 additionally includes within the mouthpiece means 37 for supporting a solid medication. As illustrated within FIGS. 8 and 9, the mouthpiece 25 includes a recess 39 for receiving a bead 41 on the interior of sleeve 27. Additionally the lower extremity 43 of sleeve 27 is preferably tapered in order to receive first conduit means such as a soda fountain straw on the exterior thereof. As an alternative, however, the extremity 43 may possess a ridge on the interior thereof. As an engineering alternative to the modification shown in FIGS. 8 and 9, the one way valve may be formed as a part of the inner mouthpiece member rather than as a part of the sleeve portion. In this alternative, the lower extremity of mouthpiece 25 may extend out of sleeve 27 to communicate with first conduit means.

FIGS. 10–13 illustrate another embodiment of the medicine doser in which solid medicine to be orally administered is placed in dosage form into a mouthpiece device which also serves as a dispensing container. The mouthpiece is a relatively short straight transparent plastic tube 50 having a removable closure cap 52 and a radially extending base plate 54 to maintain and stabilize the tube in upright position on a surface, such as a tray or table. Located just above the lower opening in the tube 50 is a transverse grid or support means, shown in FIGS. 10 and 11 as a single narrow bar or rod 56, which spans the passageway through tube 50 to define with the closure cap 52 a compartment for storing a prescribed dose of solid medication, such as one or more pills or capsules 58 (shown in dashed lines in FIG. 11). The tube typically may be about 2 inches in length, three-eighths inch internal diameter, and with a base plate diameter of about thirteen-sixteenths inch to conveniently accommodate and closely contain capsules and pills in the tube with the tube supported upright on a horizontal surface.

Figure 10:
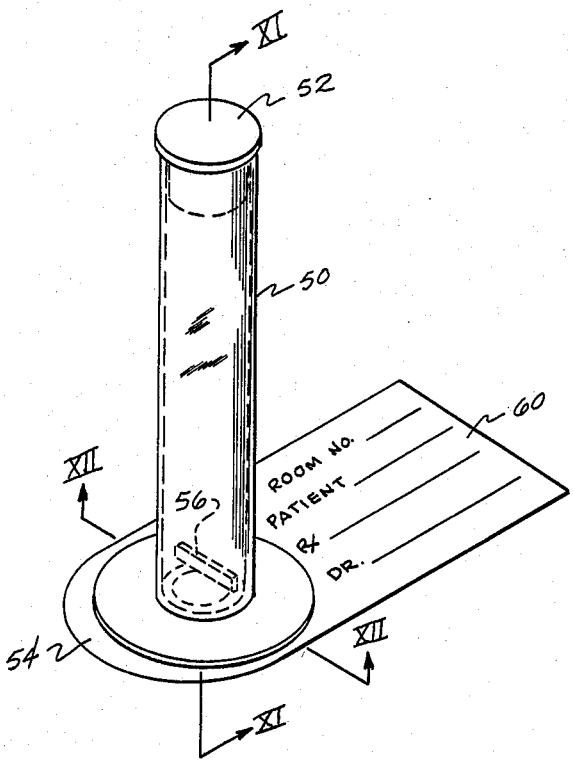
FIG. 10 illustrates in perspective view another embodiment of a solid medicine dispensing and dosing device of the present invention.

As seen in FIG. 10, the upper end of the tube 50, when used as a storage dispenser, is sealed by the closure cap 52, and the lower end of the tube may be sealed by sheet means, such as a paper or plastic identification strip or label 60 having a portion on which information, e.g., patient, room number, medication, time of medication, may be written. The label 60 may be water-resistant and a portion thereof coated with a pressure sensitive adhesive to secure it to the base plate of the tube.

Figure 11:
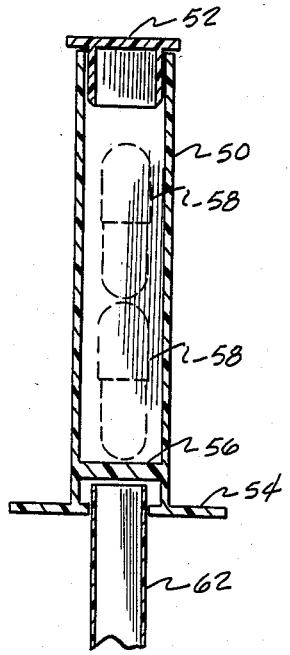
FIG. 11 is a slightly modified vertical sectional view of the device of FIG. 10 taken along line XI—XI thereof and looking in the direction of the arrows.

As seen in FIG. 11, the lower opening of tube 50 is sized to frictionally receive the end of elongate conduit means, such as a standard drinking straw 62. The inner periphery of the tube opening may be inwardly tapered to ensure sealing engagement of the tube with the straw. To use tube 50 for oral administration of the solid medicine, closure cap 52 and label 60 are removed from the tube ends, a straw is inserted into the lower opening of the tube, and the lower end of the straw 62 is inserted into a diluent liquid container. Tube 50 thus serves as a mouthpiece whereby the solid medication in the tube compartment may be quickly drawn into the oral cavity by patient inhalation of the diluent liquid through the straw, grid 56, and tube into the mouth. Since the tube diameter closely contains the solid medication, as well as aligns capsules in their narrow dimension for introduction into the mouth, the medicine is quickly propelled into and through the oral cavity by the force of movement of the diluent liquid drawn through tube 50 by inhalation suction.

Figure 12:
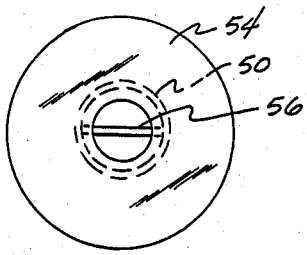
FIG. 12 is a bottom plan view of the device of FIG. 10 taken at line XII—XII and looking in the direction of the arrows.
Figure 13:
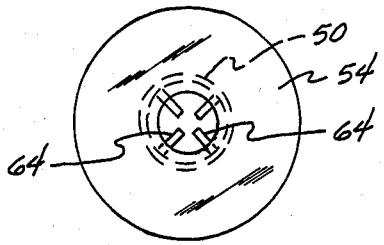
FIG. 13 is a bottom plan view, similar to FIG. 12, and showing a modified form of the device of FIGS. 10–12.

FIG. 12 is a bottom plan view taken along line XII—XII of FIG. 10, with the label removed to illustrate the position of the solid medicine support bar 56, while FIG. 13 illustrates another form of supporting grid arrangement 64 which may be employed to support and contain the solid medicine in the tube during storage and for inhalation ingestion by the patient.

Thus, it can be seen that the tubular mouthpiece 50 of FIGS. 10–13 may be inexpensively molded or formed of suitable materials, such as plastic, and be employed not only to facilitate the ingestion of solid medicine, but as a convenient dispenser for containing prescribed doses of solid medicine for delivery to a patient.

The invention shown in the embodiments disclosed herein provides a device for facilitating the oral administration of solid and liquid medicines. As the above description is exemplary in nature, many variations will become apparent from a reading thereof. Such variations, however, are included within the spirit and scope of this invention as defined by the following appended claims.

That which is claimed is:

1. A device for facilitating the administration of medication orally to a human patient comprising a relatively short tube having upper and lower openings and a passageway therethrough, a removable closure cap located in said upper opening, radially extending plate means surrounding the lower opening of the tube to support the tube in upright position on a generally horizontal surface and to receive a covering means, and grid means spanning a portion of the tube passageway adjacent the lower opening of the tube for supporting solid medication in the tube and permitting passage of a stream of liquid therethrough, and said tube including means for receiving elongate conduit means in liquid tight sealed communication with the lower opening whereby the device may be employed to store a dispensed amount of solid medication for delivery to a patient and, upon removal of the closure cap, as a mouthpiece for inhalation ingestion of the solid medication with a diluent liquid drawn through the tube from a supply source.

2. A device as defined in claim 1 further including sheet means removably attached to the lower end of the tube and plate means to seal and cover the lower opening of the tube when the device is employed to store a dispensed amount of solid medication for delivery to a patient.

3. A device as defined in claim 2 further wherein the sheet means comprises a label having a surface portion for display of written information and a surface portion having reans for removable attachment to said lower end of the tube and plate means.

4. A device as defined in claim 3 wherein said means for attachment of the label is a pressure-sensitive adhesive on a surface portion of the label to engage the tube plate means in sealing relation with the lower opening of the tube.

5. A device as defined in claim 1 wherein the transverse dimension of said tube is of a size to closely surround the solid medication to be administered to the patient.

6. A device as defined in claim 1 wherein the tube is composed of a transparent material to permit viewing of solid medication therein.

7. A device as defined in claim 6 wherein the device is formed of plastic.

8. A device as defined in claim 1 wherein said means for receiving elongate conduit means in communication with the lower opening comprises means defining the lower opening of the tube dimensional to receive a drinking straw within the opening in frictional sealing engagement with the side walls of the opening.

* * * * *